US011168658B2

(12) United States Patent
Cansever et al.

(10) Patent No.: US 11,168,658 B2
(45) Date of Patent: Nov. 9, 2021

(54) METHODS AND SYSTEMS FOR STARTER ACTUATION

(71) Applicant: Bayerische Motoren Werke Aktiengesellschaft, Munich (DE)

(72) Inventors: Uemit Cansever, Holzkirchen (DE); Peter Holt, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/257,385

(22) PCT Filed: Jun. 26, 2019

(86) PCT No.: PCT/DE2019/100592
§ 371 (c)(1),
(2) Date: Dec. 31, 2020

(87) PCT Pub. No.: WO2020/007406
PCT Pub. Date: Jan. 9, 2020

(65) Prior Publication Data

US 2021/0270222 A1 Sep. 2, 2021

(30) Foreign Application Priority Data

Jul. 5, 2018 (DE) ..... 10 2018 211 137.5

(51) Int. Cl.
*F02N 11/00* (2006.01)
*F02N 11/08* (2006.01)

(52) U.S. Cl.
CPC ..... *F02N 11/087* (2013.01); *F02N 11/0848* (2013.01); *F02N 2200/022* (2013.01); *F02N 2200/043* (2013.01); *F02N 2200/044* (2013.01)

(58) Field of Classification Search
CPC ..... F02N 11/087; F02N 11/0848; F02N 2200/022; F02N 2200/044; F02N 2200/043; F02N 2200/066
See application file for complete search history.

(56) References Cited

U.S. PATENT DOCUMENTS 4,887,056 A 12/1989 Kajino et al.
6,050,233 A * 4/2000 Vilou ..... F02N 11/087 123/179.3

(Continued)

FOREIGN PATENT DOCUMENTS

DE 38 52 424 T2 5/1995
DE 698 14 297 T2 5/2004

(Continued)

OTHER PUBLICATIONS

International Search Report (PCT/ISA/210) issued in PCT Application No. PCT/DE2019/100592 dated Sep. 27, 2019 with English translation (six (6) pages).

(Continued)

*Primary Examiner* — Phutthiwat Wongwian
*Assistant Examiner* — Sherman D Manley
(74) *Attorney, Agent, or Firm* — Crowell & Moring LLP

(57) ABSTRACT

A method actuates a starter of an internal combustion engine by way of a starter relay. The starter relay is configured to supply the starter optionally with current via an on-board electrical system. The method has the following steps: determining an error status of the internal combustion engine; commencing repeated actuations of the starter relay; determining a current status of the internal combustion engine, wherein the current status of the internal combustion engine displays at least one error status or at least one operating status; and, if the current status displays at least one operating status, ending the repeated actuation of the starter relay, otherwise once again determining the current (Continued)

status. A system for actuating a starter of an internal combustion engine includes a control device, a power source, a starter relay, connected to the control device and configured to supply the starter of the internal combustion engine optionally with current from the power source via an on-board electrical system, wherein the control device is configured to carry out the method.

14 Claims, 1 Drawing Sheet

(56) References Cited

U.S. PATENT DOCUMENTS

| | | | | |
|---|---|---|---|---|
| 2005/0051134 | A1* | 3/2005 | Valascho | F02D 11/107 123/399 |
| 2006/0080027 | A1 | 4/2006 | Tanaka et al. | |
| 2008/0172170 | A1 | 7/2008 | Lecole et al. | |
| 2014/0340808 | A1* | 11/2014 | Kurita | E05F 15/71 361/170 |
| 2016/0042881 | A1* | 2/2016 | Nishida | F02N 11/087 335/196 |
| 2019/0153988 | A1* | 5/2019 | Lebreux | F02N 11/04 |

FOREIGN PATENT DOCUMENTS

| | | | |
|---|---|---|---|
| DE | 10 2005 046 158 | A1 | 4/2006 |
| DE | 10 2009 035 323 | A1 | 3/2011 |
| DE | 10 2010 056 231 | A1 | 6/2012 |
| DE | 10 2011 088 722 | A1 | 6/2013 |
| DE | 10 2014 203 782 | A1 | 9/2014 |
| DE | 10 2015 112 947 | A1 | 2/2016 |
| EP | 0 744 761 | A2 | 11/1996 |
| EP | 1 645 752 | A2 | 4/2006 |
| FR | 2 875 557 | A1 | 3/2006 |
| JP | 50-9635 | U | 1/1975 |
| JP | 51-32342 | U | 3/1976 |
| JP | 54-88563 | U | 6/1979 |

OTHER PUBLICATIONS

German-language Written Opinion (PCT/ISA/237) issued in PCT Application No. PCT/DE2019/100592 dated Sep. 27, 2019 (six (6) pages).

German-language Search Report issued in German Application No. 10 2018 211 137.5 dated Jan. 28, 2019 with partial English translation (11 pages).

* cited by examiner

METHODS AND SYSTEMS FOR STARTER ACTUATION

BACKGROUND AND SUMMARY OF THE INVENTION

The disclosure relates to methods and systems for actuating a starter. The disclosure relates in particular to methods and systems for actuating a starter in vehicles having an internal combustion engine and in the cases of start-up difficulties.

A vehicle having an internal combustion engine comprises typically a starter that is used so as to switch on the internal combustion engine, so that at least one intake stroke and compression stroke is performed and so that the internal combustion engine can be started up. The starter comprises typically an electric motor, in particular a DC motor that is operated by electrical energy from a vehicle electrical system (in particular a low voltage vehicle electrical system in the case of a vehicle supply voltage of 60V or less, typically 12V or 48V) of the vehicle.

The driver of a vehicle can actuate an ignition of the vehicle (for example by way of a starter button of the vehicle). In response thereto, one or more electrical contacts are closed and the starter causes the crankshaft of the internal combustion engine to power up in order to accelerate the internal combustion engine up to the start-up rotational speed with the result that the internal combustion engine can be started.

It is possible that the internal combustion engine of a vehicle cannot be started because the starter cannot be actuated. This can be caused by problems with the supply of electric current to the starter, for example if the starter relay is iced up. In other cases, a blockage can prevent the starter from starting up, for example as a result of one or more components that are driven by the internal combustion engine (for example compressor, generator) seizing up as a result of corrosion.

In order to prevent function failures as a result of contacts icing-up, the starter that is disclosed in JP-U No. 54-88563 having a stationary contact and a movable contact uses a grooved profile for at least one of the contact surfaces. Thus, in the case of a collision in a mechanical contact closure, any ice layers that have possibly formed on the contact surfaces are broken, as a result of which sufficient electrical contact between the movable contact and stationary contact is ensured. However, the impact force of the contacts is often only small, with the result that in particular when the icing-up is more intense, the ice cannot be broken by actuating the switch and the starter does not start up. Furthermore, the use of special switches is expensive and/or requires structural changes.

Other starters that are disclosed in JP-U No. 50-9635 and 51-32342 use a heating wire that is arranged around the contacts of the solenoid switch in order by means of the heat that is generated in this manner to thaw out the ice that has formed on the contact surfaces. However, starters having heating wires of this type that emit radiated heat require a relatively long period of time. It is therefore not possible in this manner to meet the user's demand for a quick as possible start-up of the internal combustion engine. Furthermore, components are necessary in this case for controlling the electric current supply of the heating device, which increases the production costs.

The publication EP0744761 (A2) discloses a special solenoid switch that can actuate a starter motor in two steps without being impaired by iced-up contacts. For this purpose, two stationary contacts—a stationary main contact and a stationary auxiliary contact—are provided in the solenoid switch for supplying a starter motor in order to operate the starter motor in steps, firstly with a low rotational speed and subsequently with a high rotational speed. A heat-generating element in the form of a heat-generating electrical resistance is integrated and fulfils to the same extent the tasks of the rotational speed controller and also the de-icing procedure. The special solenoid switch is comparatively complex with regard to its construction since additional contacts and heating elements are required. In addition, also in this case in the presence of more intense icing-up, it is to be anticipated that the start-up procedure is delayed as a result of the length of time required for the heat-generating element to warm up. The publication does not provide any statement as to whether an internal combustion engine that has possibly become blocked or seized up can be started in two steps based on the operation of the starter motor.

The present disclosure therefore has the technical task of actuating the starter for an internal combustion engine in a precise and efficient manner, in particular in order to overcome the aforementioned and similar start-up difficulties of an internal combustion engine.

The present invention is based on a functional approach for eliminating the start-up difficulties. The starter relay and/or the starter motor are actuated in a specific manner by virtue of closing the relay contact a number of times in a controlled manner.

In the event that icing-up occurs, it is possible to break a layer of ice which is possibly present on the contacts using a sequence of pulses so as to close the relay contacts, in that by repeatedly performing closing procedures in a controlled manner following predetermined patterns the relay contacts exert a mechanical influence on the ice layer.

In the event that components are blocked, the possible prevailing blockages or components that are seized up can be released using a sequence of pulses so as to close the relay contacts and exert a corresponding influence of the starter motor on the internal combustion engine.

The currently disclosed methods and systems render it possible to eliminate problems in the case of a start-up procedure of an internal combustion engine.

In particular, the currently disclosed methods and systems render it possible to start-up the internal combustion engine under conditions under which it is to be anticipated that the starter relay contact ices up, for example in the case of low temperatures, high temperature gradients, high levels of air humidity, under the influence of heavy snow storms or precipitations, and/or in the case of a great deal of condensation or moisture having formed in the engine compartment.

Furthermore, the currently disclosed methods and systems render it possible to start up the internal combustion engine if the internal combustion engine and/or individual components of the internal combustion engine that are operatively connected to the crankshaft block or impair a start-up of the starter.

It is an object of the present disclosure to provide methods and systems for actuating the starter in vehicles, and vehicles having such systems, which avoid one or more of the aforementioned disadvantages and realize one or more of the aforementioned advantages.

This object is achieved by means of the respective subject matter of the independent claims. Advantageous embodiments are disclosed in the subordinate claims.

In accordance with embodiments of the present disclosure, a method for actuating a starter of an internal combustion engine by means of a starter relay in vehicles is disclosed. The starter relay is configured so as to selectively supply the starter with electric current by way of a vehicle electrical system. The method includes determining an error state of the internal combustion engine; starting multiple actuations of the starter relay; determining a prevailing state of the internal combustion engine wherein the prevailing state of the internal combustion engine indicates at least one error state or at least one operating state; and if the prevailing state indicates at least one operating state, terminating the repeated actuation of the starter relay, otherwise repeating the procedure of determining the prevailing state.

It is preferred that the procedure of actuating the starter relay also includes closing the starter relay for a first predetermined period of time and subsequently opening the starter relay for a second predetermined period of time.

It is preferred that the method also includes actuating the starter relay for the first time. The first predetermined period of time in the event of the starter relay being actuated for the first time lies in the range of up to 3000 ms, preferably in the range of up to 500 ms.

It is preferred that in the event of the repeated actuation of the starter relay the first predetermined period of time lies in the range from 130 ms to 230 ms, preferably in the region of approximately 180 ms.

It is preferred that in the event of the repeated actuation of the starter relay the second predetermined period of time lies in the range from 130 ms to 230 ms, preferably in the region of approximately 180 ms.

It is preferred that the procedure of determining the error state or the prevailing state of the internal combustion engine is performed based on one or more of the following steps:

determining an electric current consumption of the starter;

determining that the vehicle electrical system is not experiencing a voltage drop;

determining a rotational speed of the internal combustion engine; and determining an open-load error.

It is preferred that the procedure of determining an error state of the internal combustion engine is performed based on one or more of the following steps:

determining the error state based on an electric current consumption of the starter of essentially zero;

determining a voltage of the vehicle electrical system and establishing the lack of an anticipated voltage drop;

determining a voltage drop in the voltage of the vehicle electrical system that is less than an anticipated voltage drop;

determining the error state based on an established open-load error; determining the error state based on a rotational speed of the internal combustion engine of essentially zero and an electric current consumption of the starter of essentially not equal to zero; and determining the error state based on electric current consumption of the starter that is essentially greater than a normal electric current consumption of the starter in the case of regular start-up procedures of the internal combustion engine.

It is preferred that the prevailing state of the internal combustion engine also indicates at least one termination state, wherein the termination state is determined based on one or more of the following steps:

exceeding a predetermined time limit since the start of the repeated actuation of the starter, wherein optionally the predetermined time limit amounts up to 15 seconds, preferably up to 10 seconds;

exceeding a maximal number of actuations of the starter within a predetermined time period, wherein optionally the maximal number is less than 50, preferably less than 30, and/or the predetermined time period is less than 15 seconds, preferably less than 10 seconds;

rescinding a request to start-up the internal combustion engine by a user or an engine controller; and starting up the internal combustion engine;

wherein the method also includes; if the prevailing state indicates at least one termination state, terminating the repeated actuation of the starter relay.

In accordance with embodiments of the present disclosure, a system is also proposed for actuating a starter of an internal combustion engine. The system comprises a control unit; an electric current source; a starter relay, connected to the control unit and configured so as to supply the starter of the internal combustion engine by way of a vehicle electrical system selectively with electric current from the electric current source. The control unit is configured so as to perform the currently disclosed method.

In accordance with embodiments of the present disclosure, a vehicle is also disclosed comprising the currently disclosed system.

It is to be noted that the methods, devices and systems described in this document can be used both as stand-alone and also in combination with other methods, devices and systems described in this document. Furthermore, any aspects of the methods, devices and systems described in this document can be combined with one another in numerous ways. In particular, the features of the claims can be combined with one another in numerous ways.

Exemplary embodiments of the disclosure are illustrated in the figures and described in detail below.

BRIEF DESCRIPTION OF THE DRAWINGS

Insofar as not otherwise stated, like reference numerals are used below for like and like-functioning elements.

DETAILED DESCRIPTION OF THE DRAWINGS

Figure 1:
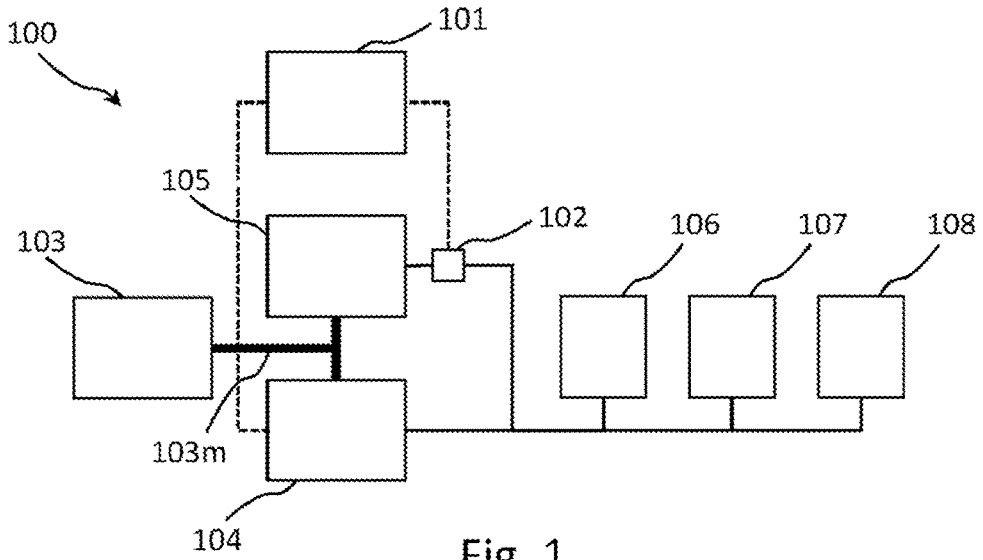
FIG. 1 illustrates an exemplary vehicle electrical system of a vehicle having a starter for an internal combustion engine in accordance with embodiments of the present disclosure.

FIG. 1 illustrates an exemplary vehicle electrical system 100 of a vehicle having a starter 105 for an internal combustion engine 103 in accordance with embodiments of the present disclosure. FIG. 1 illustrates a block diagram of an exemplary low voltage vehicle electrical system 100. The vehicle electrical system 100 typically comprises a nominal voltage of 12V-14V and is therefore frequently also described as a 12V or 14V vehicle electrical system. Alternatively the vehicle electrical system 100 can comprise a different voltage, for example a vehicle supply voltage of 48V.

The vehicle electrical system 100 comprises one or more electrical consumers 108 (for example infotainment system, air conditioning), which are supplied with electrical energy from the vehicle electrical system 100. In order to store electrical energy, the vehicle electrical system 100 can comprise one or more electric current sources 106, 107 (for example energy storage device, battery, rechargeable battery). In the illustrated example, the vehicle electrical system 100 comprises a lead acid rechargeable battery as an electric current source 106, which can be used for the purpose of supporting the vehicle supply voltage and providing electrical energy for the starter 105 of the internal combustion engine 103.

As already mentioned in the introduction, the starter 105 can be operated in order to mechanically drive the internal combustion engine 103 during a start-up procedure, (the mechanical connection used for this purpose to the crankshaft of the internal combustion engine 103 is only illustrated schematically in FIG. 1 and is provided with the reference numeral 103*m*). Furthermore, the vehicle electrical system 100 in the illustrated example comprises an energy recuperation storage device 107 (for example a Li-Ion battery), which is configured so as to store and to supply substantial quantities of electrical energy.

The vehicle electrical system 100 comprises in addition a generator 104 that is driven by way of the internal combustion engine 103 in order to convert kinetic energy into electrical energy, wherein the electrical energy can be used to operate the one or more consumers 108 and/or can be stored in the electric current sources or energy storage devices 106, 107. In thrust phases, (for example when driving downhill), in which the generator 104 is powered indirectly by way of the internal combustion engine 103 or the wheels of the vehicle, electrical energy can be recuperated by means of the generator 104 in order to reduce the energy consumption.

The vehicle electrical system 100 also comprises a control unit 101 that is configured so as to control one or more of the components of the vehicle electrical system 100. In particular, the control unit 101 can be configured so as in response to a start signal (for example by activating the ignition by means of a starter button) to control the starter 105 in order to start up the internal combustion engine 103 within the scope of a start-up procedure. For this purpose, the control unit 101 can control a starter relay 102 that supplies the starter 105 with electric current from the vehicle electrical system 100. The starter 105 of the internal combustion engine 103 may not start up or a start-up procedure may be unsuccessful owing to different causes. The malfunction resulting in the internal combustion engine 103 not starting up is frequently not to be found in the starter 105 but rather in the area of the electrical system or it is a mechanical malfunction.

An unsuccessful attempt to start-up the internal combustion engine can result in multiple disadvantages. A user of the vehicle cannot embark on a planned trip and their options are limited. Moreover, the user must establish the cause of the malfunction or must render it possible for the cause of the malfunction to be established, which results in further inconveniences. During a subsequent visit to a repair shop, it is possible that the malfunction cannot be reproduced, (for example owing to different operating conditions in which the malfunction does not occur), or that a starter 105 is replaced unnecessarily. It is frequently not possible to easily eliminate the actual cause for the unsuccessful start-up attempt.

In the case of specific weather conditions or operating conditions, it must be anticipated that the starter relay contact ices up, for example in the case of low temperatures, high temperature gradients, high levels of air humidity, under the influence of heavy snow storms or precipitations, and/or in the case of a great deal of condensation or moisture having formed in the engine compartment. Although it is possible, in cases in which the relay contacts have iced up, to control the starter relay 102 by means of the control unit 101, it is not however possible for the starter relay to produce an electrical connection between the starter 105 and the electric current source 100, 106, 107, the reason being that it is not possible to realize an electrical contact by way of the iced-up relay contacts. An ice layer existing on one or both relay contracts can insulate the contacts insofar as electric current does not flow through the contacts. As a result, the internal combustion engine 103 cannot be started in the event of the relay contacts being iced-up in this manner.

In other cases, it is possible for the mechanical drive network 103*m* of the internal combustion engine 103 to experience a mechanical problem that prevents the internal combustion engine 103 from being switched on by the starter 105. A problem can be for example that the components that are connected to the mechanical drive network 103*m* have become blocked or have seized up. Thus, for example, the generator 104 or another of the components (for example compressor of an air-conditioning system, valve drive) that are driven by the internal combustion engine 103 can become mechanically blocked and consequently, for example by way of a drive belt or a drive chain, likewise block the internal combustion engine 103. As a result, the internal combustion engine 103 can also not be started in the event of such a blockage.

It is possible for the control unit 101, for example by detecting a so-called "open-load error", to determine that the internal combustion engine 103 has not started up. Moreover, it is possible for the control unit 101 based on an electric current consumption by the starter 105 to determine whether the starter 105 is being supplied with electric current or not. It is possible to directly measure the amount of electric current consumed by the starter 105 or also to determine the electric current consumption by way of a drop in voltage or voltage drop in the vehicle electrical system. Furthermore, it is possible for the control unit 101 to determine by way of a determined rotational speed of the internal combustion engine 103 whether there is a mechanical blockage or not. In general, the aforementioned methods can be used individually or in combination in order to determine that the internal combustion engine 103 has not started and/or to determine the current operating parameters of the internal combustion engine 103.

In one example, the control unit 101 determines that the starter 105 has an electric current consumption of essentially zero, while the starter relay 102 is closed or has been controlled so as to be closed. In this example, it is possible to conclude that the contacts of the starter relay 102 have become iced up, or that there is another problem with the electric current supply of the starter 105. As already mentioned, it is possible to determine the electric current consumption of the starter 105 additionally or alternatively by way of a voltage drop in the vehicle electrical system and thus to recognize that icing-up has occurred. It is possible from this to conclude the desired behavior, namely that the vehicle supply voltage is interrupted or must be interrupted if the starter 105 is actuated since the starter draws a very high current. If it is not possible to establish a voltage drop, then it is to be assumed that the actuation has not been successful.

In a further example, the control unit 101 determines that the starter has an electric current consumption of essentially not equal to zero (for example a normal electric current consumption during the start-up of the internal combustion engine 103) while the internal combustion engine 103 has a rotational speed of essentially zero. In this example, it is possible to conclude that the internal combustion engine 103 is blocked. Alternatively or additionally, it is also possible in this event to detect a voltage drop, selectively in combination with the (lack of) rotational speed of the internal combustion engine 103.

In a further example, the control unit 101 determines that the starter has an electric current consumption of essentially clearly not equal to zero (for example a current consumption that is considerably greater than the normal electric current consumption). In this example, it is possible to conclude selectively also based on a rotational speed of the internal combustion engine 103 of zero or approximately zero, likewise that the internal combustion engine 103 has become blocked.

It goes without saying that other error states are conceivable in which the internal combustion engine 103 does not start-up despite the appropriate actuation of the starter relay 102 by the control unit 101. The control unit 101 can also be configured to determine such error states.

As soon as the control unit has determined that the internal combustion engine 103 has not started up (for example an error state in the internal combustion engine 103), it is possible by way of actuating the starter relay 102 to undertake measures that render it possible in many cases to still start the internal combustion engine 103, without additional structural measures or manual interventions, based exclusively on a specific actuation of the starter relay or starter.

In accordance with embodiments of the present disclosure, the starter relay 102 is actuated in a pulsed manner based on a specific pattern with the result that not only is a one-off closing procedure for closing the electric current circuit for the starter triggered but rather a pulsed actuation is performed wherein the starter relay is closed numerous times and re-opened.

In this manner, it is possible in the event of the starter relay becoming iced-up to break up the ice by repeating the mechanical effect of the closing contacts and essentially to remove the ice with the result that the electric current supply to the starter 105 is reinstated without manual interventions. It is then possible to start the internal combustion engine 103 in a typical manner without any problem.

In the event of a blockage occurring, it is possible by repeatedly activating the starter 105 to induce mechanically a force, one or multiple pulses, vibrations or the like into the mechanical drive network, which can potentially release the blockage. In particular, if the blocked component has seized up as a result of corrosion (for example weather conditions, rust, contamination caused by de-icing salt or de-icing grit), it is often possible to release the blockage by repeatedly activating the starter 105 in a pulsed manner.

Figure 2:
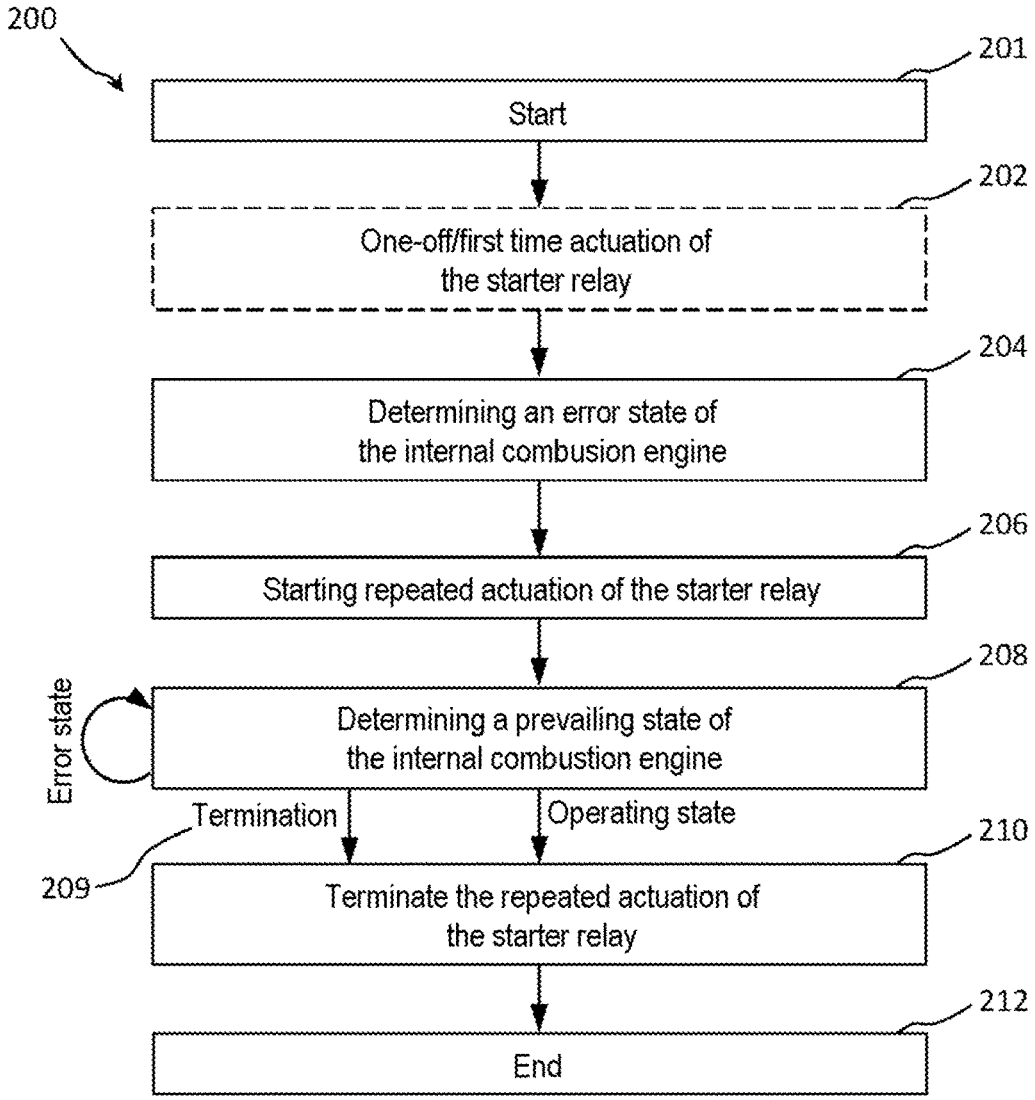
FIG. 2 illustrates a flow diagram of a method for actuating the starter in accordance with embodiments of the present disclosure.

FIG. 2 illustrates a flow diagram of a method 200 for actuating a starter 105 of an internal combustion engine 103 in accordance with embodiments of the present disclosure. The starter 105 is actuated by means of a starter relay 102, wherein the starter relay 102 is configured so as to supply the starter 105 selectively with electric current. In this case, the starter 105 is applied selectively with electric current by means of the starter relay 102 (in other words the working contacts of the relay are closed) or disconnected from the electric current (in other words the working contacts of the relay are opened). The method 200 commences in step 201. In the optional step 202, the starter relay can be actuated for the first time in order to attempt to start the engine.

In step 204, an error state of the internal combustion engine 103 is determined. In this case, an error state of the internal combustion engine 103 is considered during the start-up procedure, in which a defect can be in the internal combustion engine 103, in the vehicle electrical system (for example wiring, battery) or in the starter. The error state of the internal combustion engine can be determined based on one of the following: determining an electric current consumption of the starter 105, determining (the lack of) a voltage drop in the vehicle electric system 100 (such a voltage drop regularly occurs during the scheduled or error-free start-up of the internal combustion engine), determining a rotational speed of the internal combustion engine 103 and/or determining an open-load error. For example, the error state can be determined based on an electric current consumption of the starter 105 of essentially zero (and/or based on the lack of a voltage drop in the vehicle electrical system 100; see above), wherein in this example the starter relay has probably iced up. Moreover, the error state can be determined for example based on an established open-load error (probably iced-up or blocked). In a further example, the error state can be determined based on a rotational speed of the internal combustion engine 103 of essentially zero and an electric current consumption of the starter 105 of essentially not equal to zero wherein in this example a blockage has probably occurred. Moreover, the error state can be determined based on an electric current consumption of the starter 105 that is essentially greater than a normal electric current consumption of the starter 105 during regular start-up procedures of the internal combustion engine 103. A blockage has also probably occurred in this example.

In step 206, after the presence of an error state has been determined, the starter relay 102 is repeatedly actuated. Actuating the starter relay 102 generally means closing and subsequently opening the relay or the working contacts of the relay. In general, the actuation procedure includes regularly performing or not performing the actuation, wherein during this procedure the internal combustion engine 103 is continuously monitored as to whether in the meantime the internal combustion engine has been able to start up (and consequently eliminate the error state). In this case, the contacts are closed or opened according to a predetermined pattern.

Under normal circumstances, it is generally possible to perform a start-up procedure very quickly. In the case of warm temperatures, values below 500 ms are possible and in the case of very cold temperatures values up to 3000 ms are possible. Fundamentally, the aforementioned values apply in the case of a functional electric current circuit, in other words the starter 105 is operated in this period of time until the combustions generate a torque and as a result of which the internal combustion engine 103 can run independently. In the case of a non-functional electric current circuit, the start-up procedure up to approximately 600 ms is observed, wherein the replacement reaction is then started.

In the event that problems occur, the contacts are closed and opened in a pulsed manner preferably with a period of approximately 360 ms and a duty cycle of 50%. This means that the contacts of the starter relay 102 are initially closed for a period of time of approximately 180 ms and are subsequently opened for a period of time approximately 180 ms. The cycle is subsequently repeated as long as the internal combustion engine 103 has not started up or a termination condition is fulfilled (for example time limit), user request or user termination, engine starts).

In general, the aforementioned cycle can also be longer or shorter, for example with a duration period of up to 500 ms, preferably 460 ms, likewise in the case of a duty cycle of 50%. Other duty cycles or time periods can be used in some embodiments.

In step 208, a prevailing state of the internal combustion engine 103 is determined, wherein the prevailing state of the internal combustion engine 103 indicates at least one error state or at least one operating state. This means that the prevailing state was either still an error state (or it contains an error state), or that the prevailing state is an operating state (or it contains such an operating state). In the first case, the internal combustion engine 103 could still not be started (error state), however in the second case it could be started (operating state). If the prevailing state indicates at least one operating state, the repeated actuation of the starter relay 102 is terminated in step 210. Otherwise, the procedure of determining 208 the prevailing state is repeated until (cf. Move to 209) a termination condition (see above), in particular one of the following cases, occurs: achieving a predetermined time limit or achieving a maximal number of actuations within a predetermined period of time. In accordance with the present disclosed embodiments, the predetermined time limit amounts to approximately 15 seconds, preferably to approximately 10 seconds, and/or the maximal number of actuations amounts to approximately 50 cycles (a 360 ms), preferably to approximately 30 cycles (a 360 ms). The method ends with step 212.

When in this document a vehicle is mentioned, the vehicle is in this case preferably a multi-track motor vehicle (passenger car, truck, transporter). This results in multiple advantages that are explicitly described within the scope of this document and also multiple further advantages that can be understood by the person skilled in the art.

Although the invention has been further illustrated and explained in detail by means of the preferred exemplary embodiments, the invention is not limited by the disclosed examples and other variations can be derived therefrom by the person skilled in the art without abandoning the protective scope of the invention. It is therefore clear that a multiplicity of possible variations exist. It is likewise clear that embodiments mentioned by way of example actually only represent examples that are not to be regarded in any way as a limitation possibly of the scope of protection of the possible applications or of the configuration of the invention. On the contrary, the aforementioned description and the description of the figures enables the person skilled in the art to specifically implement the exemplary embodiments, wherein the person skilled in the art with the knowledge of the disclosed inventive idea can make numerous changes for example with respect to the function or the arrangement of individual elements mentioned in an exemplary embodiment without abandoning the scope of protection which is defined by the claims and their legal counterparts, such as further-reaching explanations in the description.

What is claimed is:

1. A method for actuating a starter of an internal combustion engine by way of a starter relay, wherein the starter relay is configured so as to supply the starter selectively with electric current by way of a vehicle electrical system, the method comprising the acts of:

determining an error state of the internal combustion engine;

starting repeated actuations of the starter relay;

determining a prevailing state of the internal combustion engine, wherein the prevailing state of the internal combustion engine indicates at least one error state or at least one operating state; and when the prevailing state indicates at least one operating state, terminating the repeated actuation of the starter relay, otherwise repeating the procedure of determining the prevailing state.

2. The method according to claim 1, wherein the act of actuating the starter relay comprises:

closing the starter relay for a first predetermined period of time and subsequently opening the starter relay for a second predetermined period of time.

3. The method according to claim 2, further comprising:

actuating the starter relay for a first time, wherein the first predetermined time period in the case of the starter relay being actuated for the first time lies in the range of up to 3000 ms.

4. The method according to claim 2, wherein in an event of the repeated actuation of the starter relay, the first predetermined period of time lies in the range of 130 ms to 230 ms.

5. The method according to claim 4, wherein in an event of the repeated actuation of the starter relay, the second predetermined period of time lies in the range of 130 ms to 230 ms.

6. The method according to claim 2, wherein in an event of the repeated actuation of the starter relay, the second predetermined period of time lies in the range of 130 ms to 230 ms.

7. The method according to claim 1, wherein the act of determining the error state or the prevailing state of the internal combustion engine is performed based on one or more of the following acts:

determining an electric current consumption of the starter;

determining that the vehicle electrical system is not experiencing a voltage drop;

determining a rotational speed of the internal combustion engine; and determining an open-load error.

8. The method according to claim 1, wherein the act of determining an error state of the internal combustion engine is performed based on one or more of the following acts:

determining the error state based on an electric current consumption of the starter of essentially zero;

determining a voltage of the vehicle electrical system and establishing a lack of an anticipated voltage drop;

determining a voltage drop in the voltage of the vehicle electrical system that is less than an anticipated voltage drop;

determining the error state based on an established open-load error;

determining the error state based on a rotational speed of the internal combustion engine of essentially zero and an electric current consumption of the starter of essentially not equal to zero; and determining the error state based on electric current consumption of the starter that is essentially greater than a normal electric current consumption of the starter in the case of regular start-up procedures of the internal combustion engine.

9. The method according to claim 1, wherein the prevailing state of the internal combustion engine also indicates at least one termination state, wherein the termination state is determined based on one or more of the following acts;

exceeding a predetermined time limit since the start of the repeated actuation of the starter, wherein the predetermined time limit amounts up to 15 seconds;

exceeding a maximal number of actuations of the starter within a predetermined time period, wherein the maximal number is less than 50, and/or the predetermined time period is less than 15 seconds;

rescinding a request to start-up the internal combustion engine by a user or an engine controller; and starting up the internal combustion engine;

the method further comprising the act of:

when the prevailing state indicates at least one termination state, terminating the repeated actuation of the starter relay.

10. The method according to claim 2, further comprising:

actuating the starter relay for a first time, wherein the first predetermined time period in the case of the starter relay being actuated for the first time lies in the range of up to 500 ms.

11. The method according to claim 2, wherein in an event of the repeated actuation of the starter relay, the first predetermined period of time lies in a region of approximately 180 ms.

12. The method according to claim 11, wherein in an event of the repeated actuation of the starter relay, the second predetermined period of time lies in a region of approximately 180 ms.

13. A system for actuating a starter of an internal combustion engine, comprising:

a control unit;

an electric current source;

a starter relay, connected to the control unit and configured so as to supply the starter of the internal combustion engine selectively with electric current from the electric current source, wherein the control unit is configured so as to perform the acts of:

determining an error state of the internal combustion engine;

starting repeated actuations of the starter relay;

determining a prevailing state of the internal combustion engine, wherein the prevailing state of the internal combustion engine indicates at least one error state or at least one operating state; and when the prevailing state indicates at least one operating state, terminating the repeated actuation of the starter relay, otherwise repeating the procedure of determining the prevailing state.

14. A vehicle comprising the system according to claim 13.

* * * * *